US005741569A

United States Patent [19]

Votino et al.

[11] Patent Number: 5,741,569

[45] Date of Patent: Apr. 21, 1998

[54] SHOE AND SOCK DONNING DEVICE FOR PHYSICALLY HANDICAPPED

[76] Inventors: Anthony Votino, 16439 Glenhope Dr., Valinda, Calif. 91744; Louis Votino, 1625 Alvarado St., Oceanside, Calif. 92054

[21] Appl. No.: 714,245

[22] Filed: Sep. 16, 1996

[51] Int. Cl.[6] ..... A47G 25/80; A47G 25/82

[52] U.S. Cl. ..... 428/131; 428/174; 428/83; 428/220; 223/112; 223/118; 223/119; 223/111

[58] Field of Search ..... 428/131, 174, 428/83, 220; 223/112, 118, 119, 111

[56] References Cited

U.S. PATENT DOCUMENTS

| | | | |
|---|---|---|---|
| 33,456 | 10/1861 | Worden | 223/118 |
| D. 224,365 | 7/1972 | Lewis | D86/10 |
| 990,283 | 4/1911 | Merrow | 223/118 |
| 1,271,069 | 7/1918 | Orr | 223/118 |
| 2,366,097 | 12/1944 | Gesell | 223/118 |
| 2,982,453 | 5/1961 | Zicarelli | 223/112 |
| 3,175,367 | 3/1965 | Evans | 223/118 |
| 3,410,463 | 11/1968 | Carlos | 223/118 |
| 4,290,539 | 9/1981 | Lowery | 223/118 |
| 5,322,199 | 6/1994 | White | 223/111 |

*Primary Examiner*—William Watkins
*Attorney, Agent, or Firm*—John R. Ross

[57] ABSTRACT

A sock and shoe donning device to facilitate a user inserting his foot in a sock and a shoe simultaneously. A C-shaped structure preferably is about as tall as the distance between the bottom of the heel of a typical sock and the top edge of the sock. It is comprised of an approximately rectangular shaped sheet of thin semirigid flexible material molded into a shape with approximately vertical sides and a C-shaped horizontal cross section. A lower portion comprises: two lower support parts preferably separated from each other by about 6 inches which when compressed toward each other to fit inside the shoe react by applying force against the inside of the shoe to hold the structure firmly in place and two tongue parts separated from each other by about 5½ inches which when compressed toward each other to fit inside the shoe react by forcing the tongue (and laces if any) of the shoe forward out the way while the user inserts his foot in the shoe. An upper portion extending upward has a C shaped top edge providing a frame on which said sock is draped with the top edge and sock and heel on the outside of the C-shaped structure and the sock toe on the inside of the C-shaped structure. The sock and shoe are donned by inserting the foot into the sock and sliding the foot downward and forward into the shoe until it is in place inside the shoe. The C-shaped structure is then slipped out of the shoe.

9 Claims, 2 Drawing Sheets

SHOE AND SOCK DONNING DEVICE FOR PHYSICALLY HANDICAPPED

This invention relates to devices for donning shoes and socks and in particular to such devices for use by people who can not reach their feet with their hands.

BACKGROUND OF THE INVENTION

Shoe horns have been available for very many years to help people insert their feet into shoes, especially tight shoes or shoes which have not been broken in. Typical shoe horns are about 3 or 4 inches long and about 1½ inches wide with the 1½ inches dimension having a curved shape to match the horizontal curvature of a persons heel. Typically a person using a prior art shoe horn will positioned the shoe horn inside the shoe at the back of the shoe and insert his foot into the shoe while holding the top edge of the shoe horn with one of his hands. The shoe horn helps guide the foot into the shoe. There are a very large number of people who for various reasons cannot reach their feet with either hand. Many people, including many people with arthritic conditions, can reach their feet but experience pain in doing so and some people cannot or have great difficulty tieing their shoe laces. These people typically get help putting on their shoes or wear slipper type shoes that they can merely slide their feet into without the need of using their hands. Devices have been proposed to permit handicapped to put on their own shoes and socks. See, for example, U.S. Pat. No. 4,355745 issued to Nelson which proposed a shoe horn with a long handle and U.S. Pat. No. 3,604,604 issued to Ahn to enable a handicapped person to put on his own socks. Prior art devices shoe horn devices work well only if the shoe is loose or the laces are untied when the shoe is put on.

What is needed is a better device for donning shoes and socks by persons who cannot easily reach their feet with their hands and which will work with many types of shoes including pretied shoes with laces.

SUMMARY OF THE INVENTION

The present invention provides a sock and shoe donning device to facilitate a user inserting his foot in a sock and a shoe simultaneously. A C-shaped structure preferably is about as tall as the distance between the bottom of the heel of a typical sock and the top edge of the sock. It is comprised of an approximately rectangular shaped sheet of thin semi-rigid flexible material molded into a shape with approximately vertical sides and a C-shaped horizontal cross section. A lower portion comprises: two lower support parts preferably separated from each other by about 6 inches which when compressed toward each other to fit inside the shoe react by applying force against the inside of the shoe to hold the structure firmly in place and two tongue parts separated from each other by about 5½ inches which when compressed toward each other to fit inside the shoe react by forcing the tongue (and laces if any) of the shoe forward out the way while the user inserts his foot in the shoe. An upper portion extending upward has a C shaped top edge providing a frame on which said sock is draped with the top edge and sock and heel on the outside of the C-shaped structure and the sock toe on the inside of the C-shaped structure. The sock and shoe are donned by inserting the foot into the sock and sliding the foot downward and forward into the shoe until it is in place inside the shoe. The C-shaped structure is then slipped out of the shoe. The present invention is especially useful for physically disabled people, people with back problems or arthritic conditions and for excessively heavy weighted people.

DETAILED DESCRIPTION OF PREFERRED EMBODIMENTS

Preferred embodiments of the present invention can be described by reference to the drawings. These drawings depict a prototype model of an embodiment of the present invention which Applicant has fabricated to demonstrate his invention. The prototype been used very successfully by one of the Applicants who is unable to reach his feet with his hands due to an arthritic condition and back and knee problems.

C-Shaped Sock and Shoe Donning Device

Figure 1:
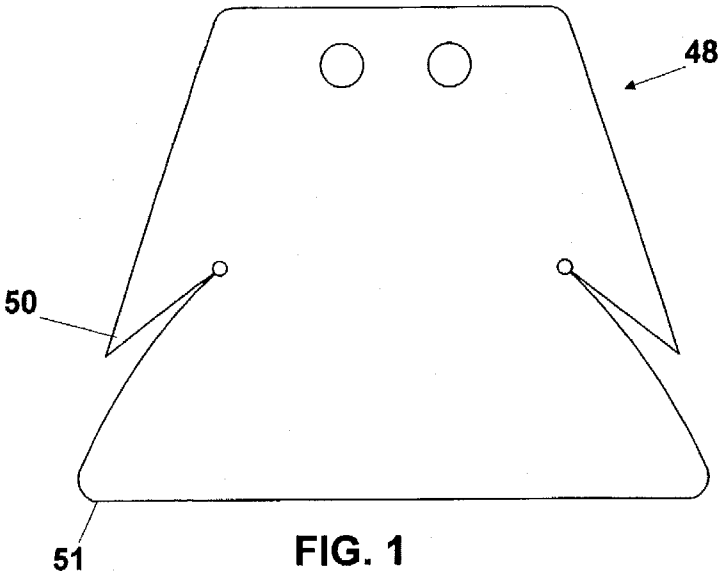
FIGS. 1 and 2 show a device for donning socks and shoes.
Figure 2:
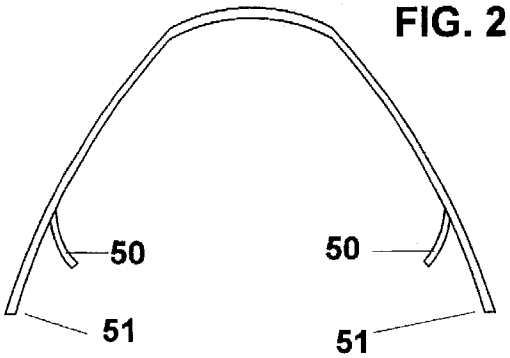
Figure 3:
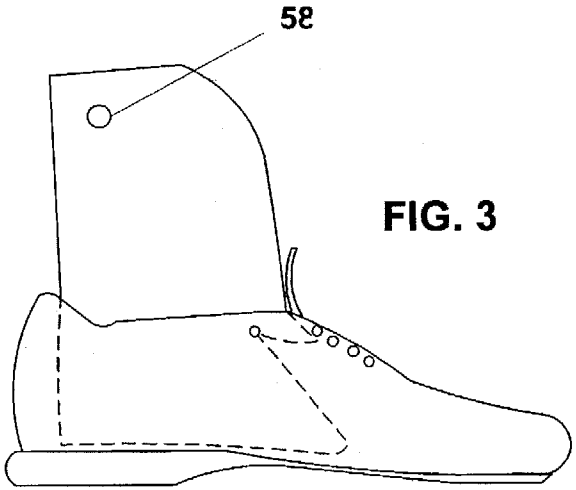
FIGS. 3 and 4 show the FIG. 1 device ready to use.
Figure 4:
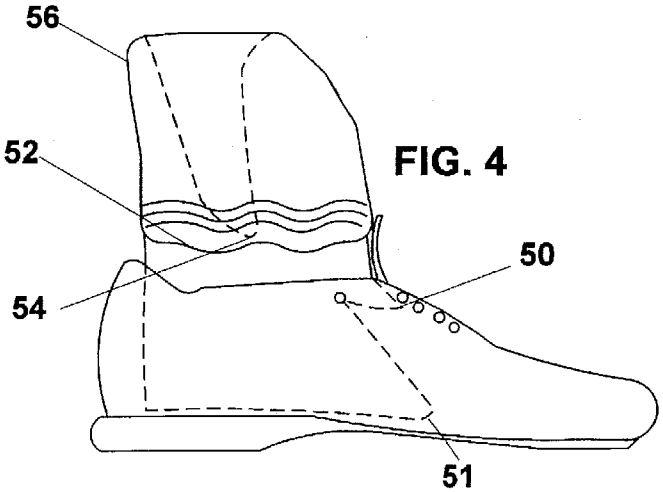
Figure 5:
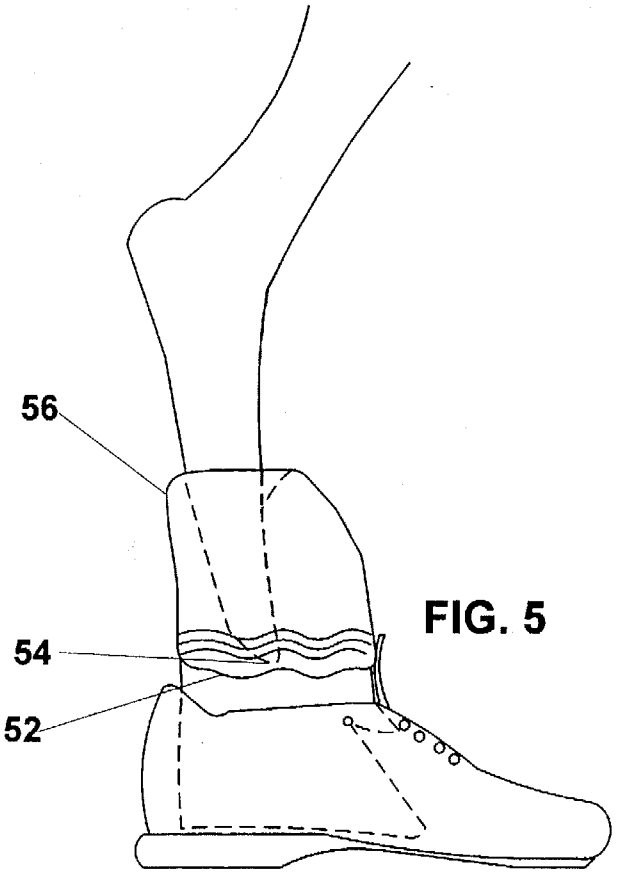
FIGS. 5, 6 and 7 show the device being used.
Figure 6:
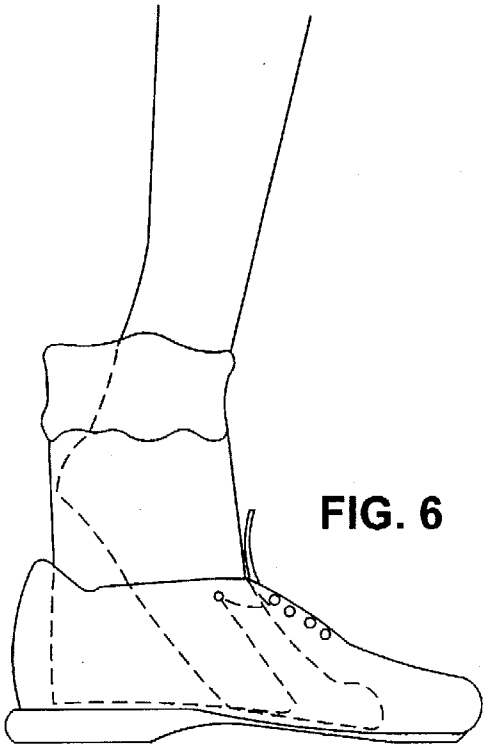
Figure 7:
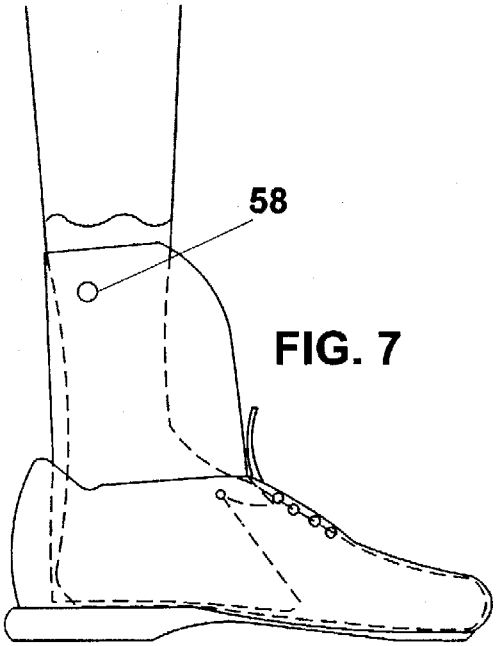

A simple sock and shoe donning device 48 is described by reference to FIGS. 1 through 7. It is comprised of sheet of 1/16 inch thick polyethylene cut in the pattern shown in FIG. 1. It is roughly rectangular, 8¼ inches high and 10 inches across the top and 13 inches across the bottom. The height 8¼ inches is the approximate distance from the bottom of the heel of a typical adult sock and the top edge of the sock. It is heat molded into the shape shown in FIG. 2. In this preferred embodiment in its relaxed state lower side support parts 51 are separated by about 6 inches. When the device is inserted into a typical adult shoe having a width of about 4½ inches as shown in FIG. 3, the structure is put under stress so that lower support parts 51 apply pressure against the inside surfaces of the shoe so as to hold device 48 firmly in place inside the shoe. Note that tongue parts 50 is deformed with a greater arc than the lower side support parts 51 which have almost no curvature. When inserted into a shoe as shown in FIG. 3, tongue parts 50 bend inward to hold the shoe tongue (and laces, if any) out of the way of the inserted foot while the lower side support parts 51 extend substantially straight forward adjacent to the sides of the shoe. A sock is spread over device 48 as shown in FIG. 4 with the top edge of the sock at 52 on the outside of device 48, the toe at 54 on the inside of device 48 and the heel at 56 on the outside of device 48. The sock and shoe are donned by inserting the foot into the sock (as shown in FIG. 5) and sliding the foot downward and forward into the shoe (as shown in FIG. 6) until it is in place inside the shoe (as shown in FIG. 7). The donning device is then slipped out of the shoe by pulling on holes 58.

While the above description contains many specificities, the reader should not construe these as limitations on the scope of the invention, but merely as exemplifications of preferred embodiments thereof. Those skilled in the art will envision many other possible variations that are within its scope. For example, although the Applicant's prototype device was fabricated using existing plastic parts and materials, commercial embodiments will preferably be mass produced using plastics molding and extrusion techniques well known in the plastics art. The device could be fabricated from many materials other than polyethylene. For example, many other thermoplastics could be used. The device could be made of thin flexible metal. A long handle could be provided for those people who could not reach to the holes 58 at the top of device 48. Accordingly, the reader is requested to determine the scope of the invention by the appended claims and their legal equivalents and not by the examples which have been given.

We claim:

1. A sock and shoe donning device to facilitate a user inserting his foot in a sock and a shoe simultaneously, said shoe defining a shoe heel, sides and a tongue and said sock defining a top edge, a sock heel and a toe, said device comprising:

a C-shaped structure comprised of a generally rectangular shaped sheet of thin semirigid flexible material molded into a structure with approximately vertical sides and a C-shaped horizontal cross section defining an inside and an outside, and having:

a lower portion comprising:

two lower support parts separated from each other by a distance of about 4 to 8 inches which when compressed toward each other to fit inside the shoe react by applying force against the inside of the shoe to hold the structure firmly in place and two tongue parts separated from each other by a distance of about 3½ to 7½ inches which when compressed toward each other to fit inside the shoe react by forcing the tongue of the shoe forward out the way while the user inserts his foot in the shoe and an upper portion extending upward form said lower portion, said upper portion defining a C-shaped top edge defining an arc length, said top edge providing a frame on which said sock can be draped with the top edge and sock heel on the outside of the C-shaped structure and the sock toe on the inside of the C-shaped structure:

wherein notches are defined in said vertical sides between said lower support parts and said tongue parts.

2. A device as in claim 1 wherein said structure defines a height of about 7 to 10 inches.

3. A device as in claim 1 wherein said semirigid flexible material is a thermoplastic.

4. A device as in claim 3 wherein said thermoplastic is heat molded into said C shape.

5. A device as in claim 3 wherein said thermoplastic is polyethylene.

6. A device as in claim 1 wherein said semirigid flexible material is a thin metal.

7. A device as in claim 1 wherein said said structure comprises at least one hole near the top edge useful for withdrawing said structure from said shoe after the foot has been inserted.

8. A device in claim 1 wherein said distance between said lower support parts is about 6 inches.

9. A device in claim 1 wherein said distance between said tongue parts is about 5½ inches.

* * * * *